US005497928A

United States Patent [19]

Burns et al.

[11] Patent Number: 5,497,928

[45] Date of Patent: Mar. 12, 1996

[54] APPARATUS FOR FEEDING WIRE HAVING A LINEARLY MOVABLE ROLLER PINCH PAIR WITH GUIDE ROD

[75] Inventors: Irvin Burns, Walloon Lake; Patrick Robbins, Petoskey, both of Mich.

[73] Assignee: Rockford Manufacturing Group, Inc., Roscoe, Ill.

[21] Appl. No.: 242,606

[22] Filed: May 12, 1994

[51] Int. Cl.[6] ..... B65H 20/02

[52] U.S. Cl. ..... 226/108; 226/186; 226/188

[58] Field of Search ..... 226/176, 186, 226/187, 188, 189, 181, 182, 183, 185; 72/274, 240, 241.6, 246

[56] References Cited

U.S. PATENT DOCUMENTS

| | | | |
|---|---|---|---|
| 1,224,046 | 4/1917 | Turley | 226/187 X |
| 2,496,947 | 2/1950 | Luboshez | 226/115 X |
| 2,668,615 | 2/1954 | Sampatacos | 226/186 X |
| 3,310,210 | 3/1967 | Reib | 226/187 X |
| 3,563,434 | 2/1971 | Shriver | 226/187 |
| 3,938,362 | 2/1976 | Falk et al. | 100/168 X |
| 4,033,496 | 7/1977 | Rolfe | 226/187 X |
| 4,149,664 | 4/1979 | Means | 226/187 X |
| 4,180,122 | 12/1979 | Sevastakis | 226/189 X |
| 4,474,342 | 10/1984 | Nater | 226/170 X |
| 5,072,872 | 12/1991 | Casset et al. | 226/186 X |

FOREIGN PATENT DOCUMENTS

| | | | |
|---|---|---|---|
| 787258 | 6/1968 | Canada | 226/189 |
| 70624 | 3/1942 | Switzerland | 226/189 |
| 1144505 | 3/1969 | United Kingdom . | |

*Primary Examiner*—Lenard A. Footland
*Attorney, Agent, or Firm*—Leydig, Voit & Mayer, Ltd.

[57] ABSTRACT

Wire is fed along a predetermined path by virtue of being pinched between an upper set of feed rolls and a lower set of feed rolls while the upper and lower rolls are rotated in opposite directions. The upper feed rolls are journaled cantilever fashion by an upper carrier which is fixed to the main frame of the apparatus. The lower feed rolls are similarly journaled by a lower carrier which is adapted to be moved upwardly toward the upper carrier to cause the lower feed rolls to pinch the wire against upper feed rolls after the wire has been threaded between the rolls. The lower carrier is moved upwardly by actuators which are offset laterally from the cantilevered rolls. To reduce cocking of the lower carrier and the lower feed rolls when the latter are forced upwardly into engagement with the wire by the offset actuators, the lower carrier is attached to a guide rod whose end portions are slidably supported by both the upper carrier and the main frame in order to spread the reaction force over a relatively long distance.

9 Claims, 4 Drawing Sheets

APPARATUS FOR FEEDING WIRE HAVING A LINEARLY MOVABLE ROLLER PINCH PAIR WITH GUIDE ROD

BACKGROUND OF THE INVENTION

This invention relates to apparatus for feeding wire along a predetermined path and, more particularly, to apparatus in which the wire is fed by pinching the wire between at least one pair of opposing feed rolls while rotatably driving the rolls in opposite directions. The rolls are journaled by and project cantilever fashion from two subsupports which are associated with a main support or frame.

To enable the wire to be threaded between the feed rolls, the subsupport for one roll is fixed to the main support while the subsupport for the other roll is guided on the main support for movement toward and away from the fixed subsupport so that the rolls may be separated for purposes of threading the wire between the rolls. Once the threading has been completed, the movable subsupport is moved toward the fixed subsupport by a spring or by a reciprocating fluid-operated actuator in order to cause the movable roll to force the wire tightly against the fixed roll. The wire thus becomes pinched between the rolls and is fed with little or no slippage when the rolls are rotated.

Because the rolls extend cantilever fashion from the subsupports, the actuator for the movable subsupport is offset laterally from the rolls. When the movable roll pushes the wire against the fixed roll, the force exerted by the laterally offset actuator tends to cause the movable roll to cock relative to the fixed roll and also produces some cocking of the fixed roll. Such cocking not only is detrimental to efficient feeding of the wire but also imposes heavy loads on the journals of the rolls and causes uneven wearing of the rolls.

SUMMARY OF THE INVENTION

The general aim of the present invention is to provide new and improved wire feeding apparatus in which the reaction force resulting from the actuator is spread over a relatively long distance in order to reduce cocking of the feed rolls and wearing of the journals thereof.

A more detailed object of the invention is to achieve the foregoing by advantageously using both the main support and the subsupport for the fixed roll to resist the reaction force resulting from forcing the wire against the fixed roll.

A still more specific object is to provide an elongated rod which guides the movable subsupport for movement toward and away from the fixed subsupport and which bears against both the fixed subsupport and the main support to distribute the reaction force.

The invention also resides in the provision of a relatively simple and inexpensive belt drive for rotating one set of feed rolls in one direction and a coacting set of feed rolls in the opposite direction.

These and other objects and advantages of the invention will become more apparent from the following detailed description when taken in conjunction with the accompanying drawings.

Figure 1:
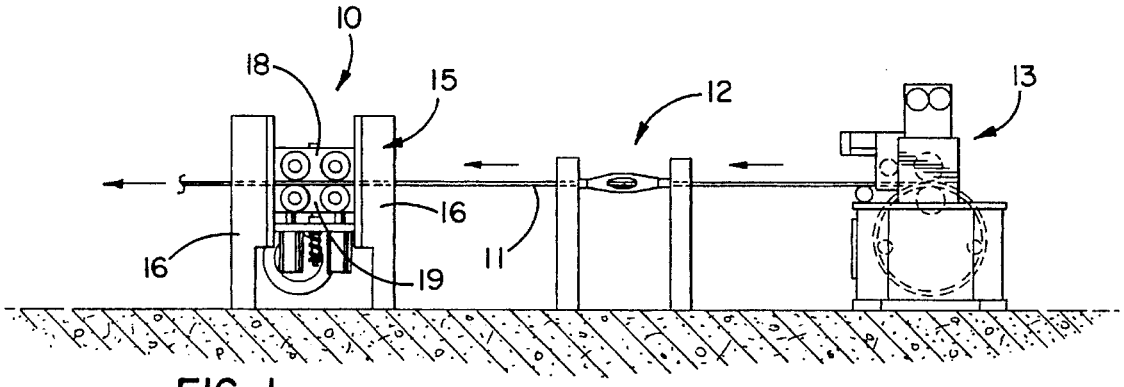
FIG. 1 is a schematic front elevational view showing a typical application of new and improved wire feeding apparatus incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as incorporated in apparatus 10 for feeding an elongated length of wire 11 along a predetermined path. While the wire feeding apparatus may be used in many different applications, it herein has been shown schematically pulling a wire through wire straightening apparatus 12 which, in turn, is supplied with wire from a wire drawing machine 13. The straightening apparatus and the drawing machine do not constitute part of the present invention and need not be further described.

Figure 2:
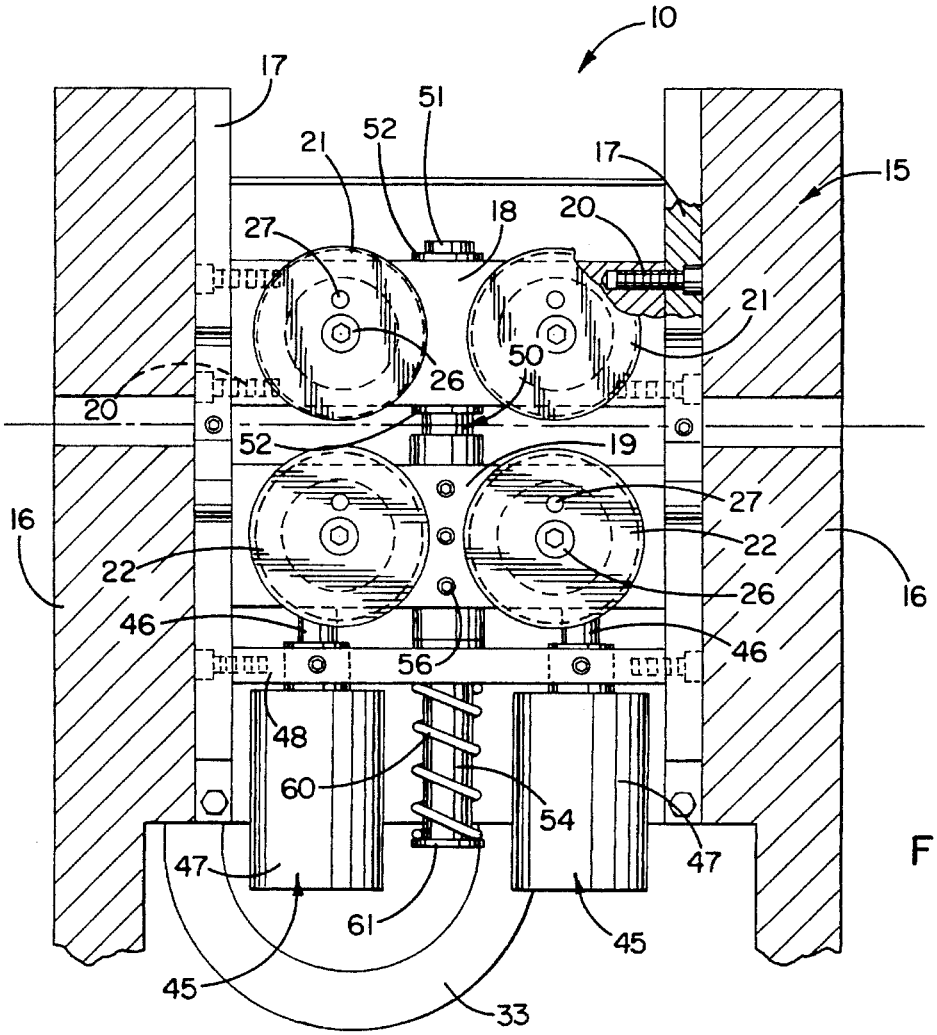
FIG. 2 is an enlarged front elevational view of certain components of the apparatus illustrated in FIG. 1, the movable feed rolls being shown separated from the fixed rolls to enable initial threading of the wire.
Figure 5:
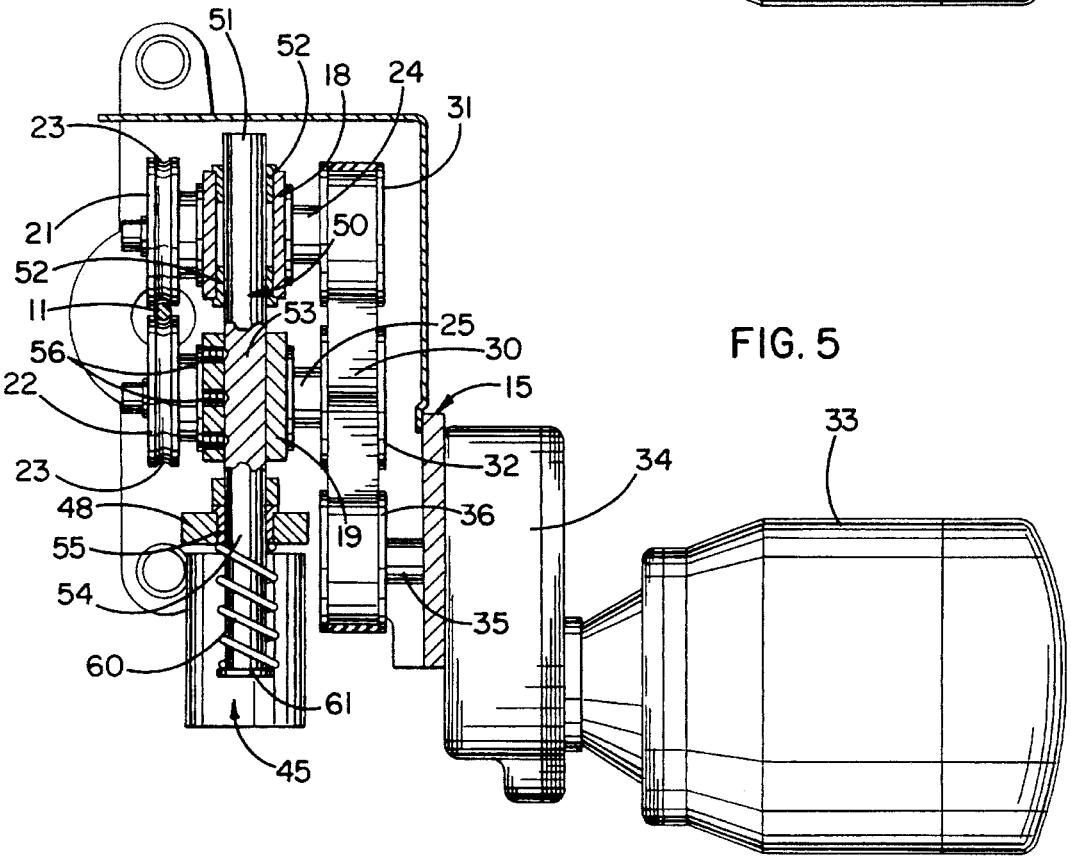

The wire feeding apparatus 10 includes a main support or frame 15 defined in part by two upstanding frame members 16 which are spaced from one another along the path followed by the wire 11. Extending between fixed plates 17 (FIG. 2) on the two frame members are upper and lower block-like subsupports or carriers 18 and 19, the upper carrier 18 being fixed rigidly to the plates by screws 20. The upper carrier 18 supports a pair of upper feed rolls 21 which are spaced from one another along the path followed by the wire 11. Located on the opposite side of the path are two similarly spaced lower feed rolls 22 supported by the lower carrier 19 and disposed in opposing relation with the upper feed rolls. Feeding of the wire is effected by pinching the wire between the upper and lower rolls and by rotating the upper rolls in one direction (herein, clockwise as viewed in FIG. 2) while rotating the lower rolls in the opposite direction. The outer peripheries of the rolls are formed with grooves 23 (FIG. 5) which guide the wire.

Figure 4:
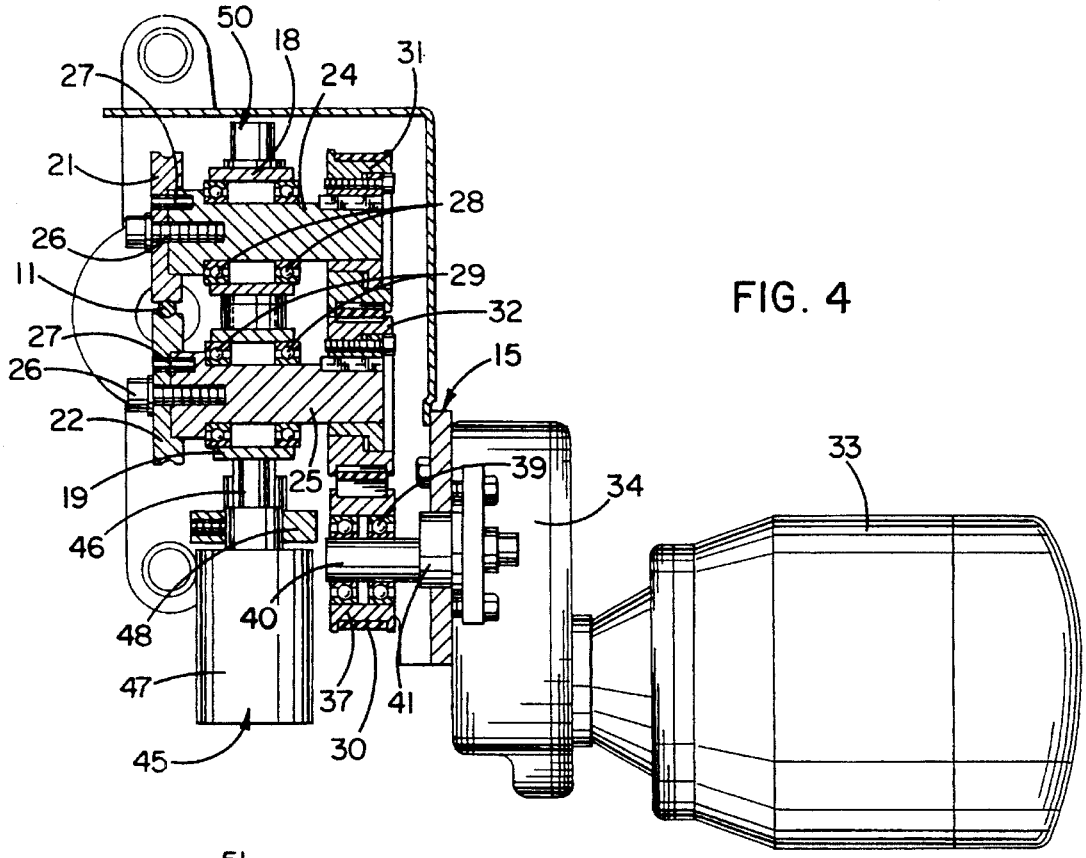
FIGS. 4 and 5 are fragmentary cross-sections taken substantially along the lines 4—4 and 5—5, respectively, of FIG. 3.

As shown most clearly in FIG. 4, the upper and lower feed rolls 21 and 22 are fixed to the forward end of shafts 24 and 25, respectively, by screws 26 and pins 27. The upper shafts 24 are journaled by ball bearings 28 supported by the upper carrier 18 while similar bearings 29 which are supported by the lower carrier 19 journal the lower shafts 25. The shafts project forwardly from the carriers and thus the rolls are supported cantilever fashion by the carriers. This enables the rolls to be quickly and easily replaced with different rolls for feeding wire of different gage.

Driving of the rolls 21 and 22 in opposite directions is advantageously effected in a relatively simple and inexpensive manner by a double-sided timing belt 30 (e.g., a flexible belt with two cogged driving sides). As will be explained in more detail subsequently, the belt is trained around upper pulleys 31 (FIG. 6) fixed to the rear end portions of the shafts 24 and around lower pulleys 32 fixed to the rear end portions of the shafts 25.

Figure 7:
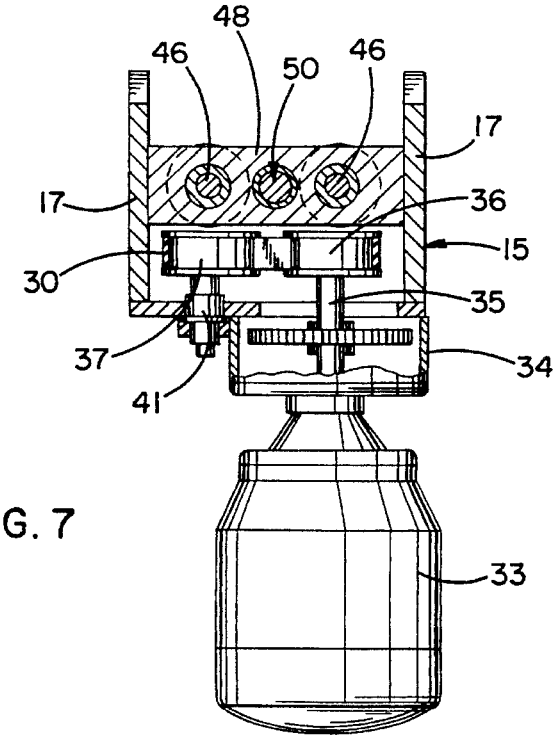
FIG. 7 is a reduced fragmentary cross-section taken substantially along the line 7—7 of FIG. 6.

The belt 30 is adapted to be driven by a variable speed electric motor 33 attached to the rear side of the frame 15 and acting through a speed-reducing gearbox 34. The latter includes a rotary output shaft 35 (FIG. 7) carrying a drive pulley 36 which is disposed alongside an idler pulley 37. A bearing 39 (FIG. 4) supports the idler pulley 37 on a shaft 40 connected to an eccentric 41 which, in turn, is supported by the frame 15 in a well known manner to enable changing of the position of the idler pulley in order to adjust the tension in the belt 30.

Figure 6:
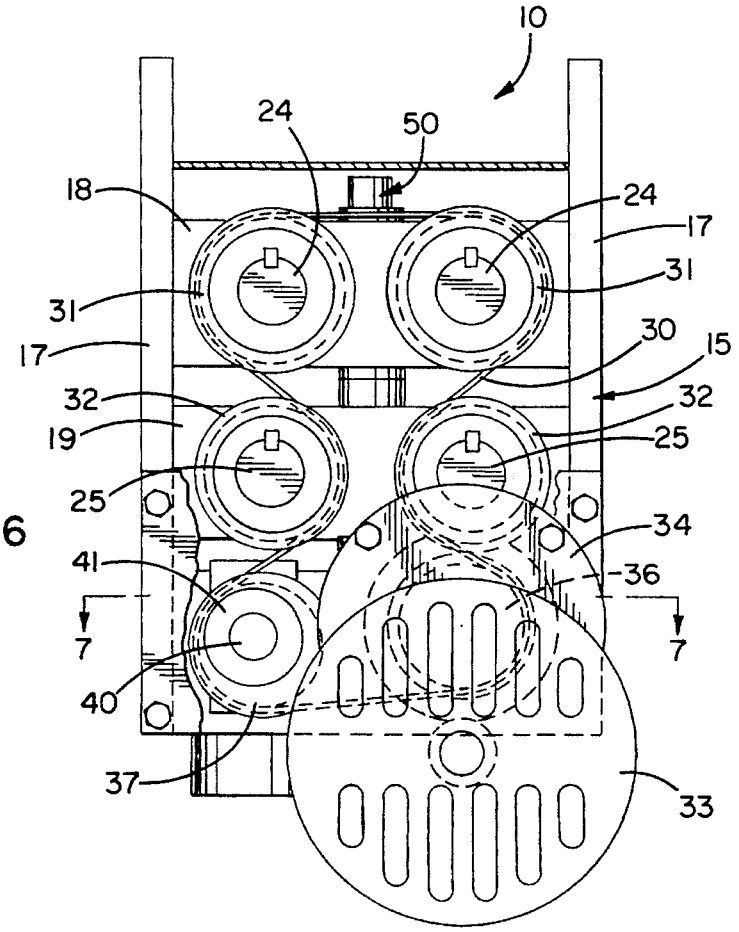
FIG. 6 is a rear elevational view of the feeding apparatus.

As shown most clearly in FIG. 6, the belt is trained around the pulleys 31, 32, 36 and 37 in a serpentine arrangement with one side of the belt in driving engagement with some of the pulleys and with the opposite side of the belt in driving engagement with the remaining pulleys. Thus, a first side of the belt engages the drive pulley 36 and the idler pulley 37, the second or opposite side of the belt engages the upstream lower pulley 32, the first side of the belt engages the two upper pulleys 31, and the second side of the belt engages the downstream lower pulley 32. As a result, the belt drives the upper feed rolls 21 in one direction and the lower feed rolls 22 in the opposite direction.

Figure 3:
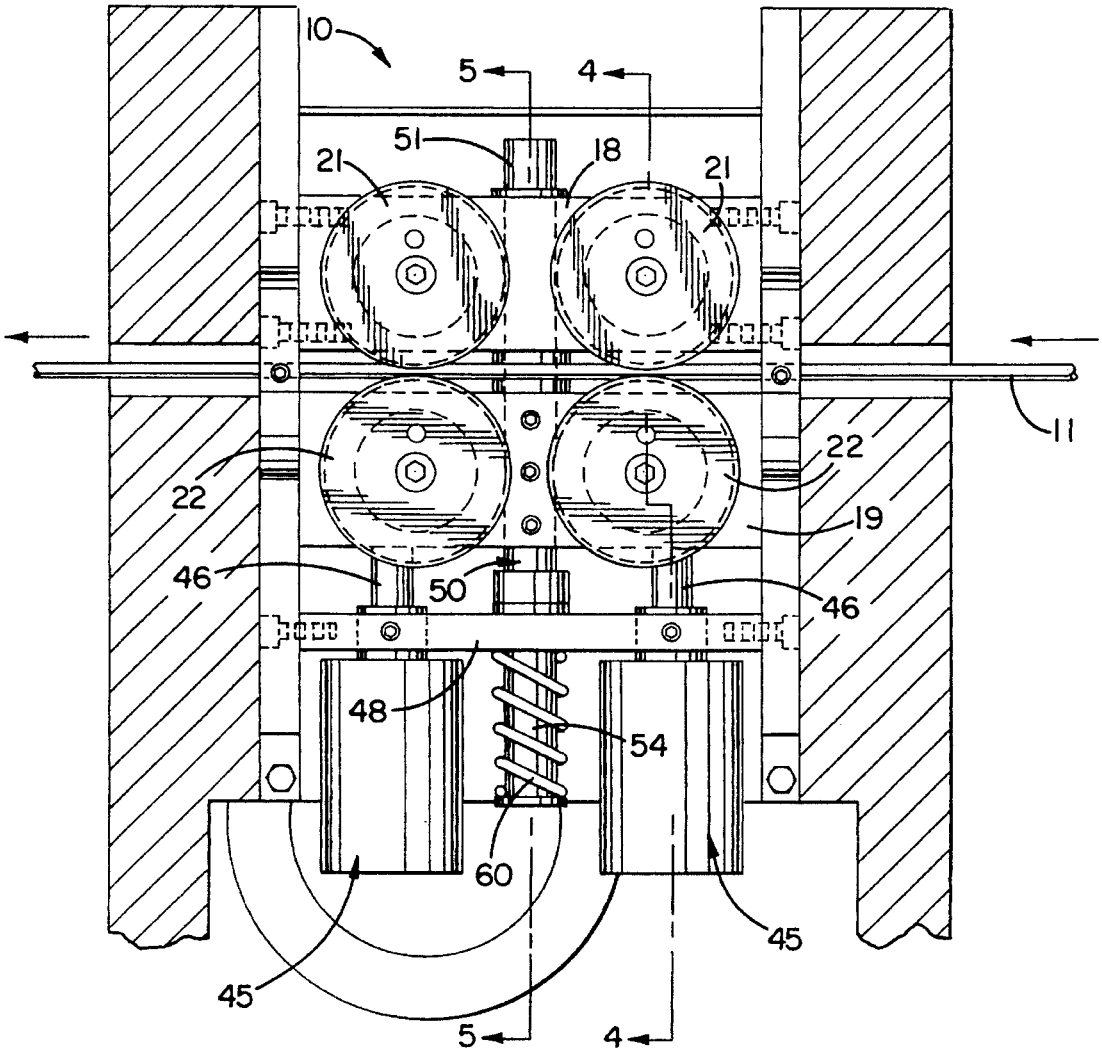
FIG. 3 is a view similar to FIG. 2 but shows the movable rolls pinching the wire against the fixed rolls.

The carrier 19 for the lower feed rolls 22 is movable from a lowered position (FIG. 2) to a raised position (FIG. 3) relative to the carrier 18 for the upper feed rolls 21. When the carrier 19 is in its lowered position, the feed rolls 22 are spaced downwardly from the feed rolls 21 to enable initial threading of the wire 11 between the opposing sets of rolls. Upon completion of the threading, the lower carrier is shifted upwardly toward the upper carrier to cause the lower feed rolls 22 to force the wire into pinching engagement with the upper feed rolls 21. In this particular instance, the lower carrier is forced upwardly toward the upper carrier by a pair of reciprocating pneumatic actuators 45 (FIG. 2) each having a rod 46 connected to the lower carrier 19 and adapted to be advanced upwardly upon pressurization of the lower end of a cylinder 47. Each cylinder is attached rigidly to a lower frame plate 48 extending between and fixed to the plates 17 and forming part of the main support or frame 15. Other force-applying means such as springs could be used in lieu of the actuators 45 to bias the carrier 19 upwardly toward the carrier 18, in which case means are provided for lowering the carrier 19 downwardly against the force of the springs in order to enable initial threading of the wire.

Because the feed rolls 21 and 22 are supported cantilever fashion by the carriers 18 and 19, the rods 46 of the actuators 45 are connected to the lower carrier at locations which are offset rearwardly from the feed rolls (see FIG. 4). As a result, the forces created when the rods 46 are advanced upwardly and when the lower feed rolls 22 push the wire 11 upwardly against the upper feed rolls 21 tend to cause the lower carrier 19 and the lower feed rolls to cock about an axis extending parallel to the wire. Such cocking detrimentally affects efficient feeding of the wire and, in addition, imposes unequal loads on the bearings 29.

In accordance with the present invention, cocking of the lower carrier 19 and the lower feed rolls 22 is reduced by guiding the lower carrier for upward and downward movement in such a manner as to spread over a substantially long distance the reaction forces resulting from upward pushing of the feed rolls 22 against the feed rolls 21 by the rearwardly offset actuators 45. By reducing the cocking, the lower feed rolls more nearly occupy the same plane as the upper feed rolls and, by virtue thereof, the wire 11 is more effectively fed and with less resultant wear on the feed rolls and the bearings 29.

More specifically, the lower carrier 19 is supported for upward and downward movement by an elongated guide rod 50 disposed in the same longitudinal plane as the rods 46 of the actuators 45 and substantially centered between the upstream pair of feed rolls 21, 22 and the downstream pair. In carrying out the invention, the guide rod 50 includes an upper end portion 51 (FIG. 5) which extends slidably through bushings 52 in the fixed upper subsupport or carrier 18, an intermediate portion 53 that extends through a bore in the movable lower carrier 19, and a lower end portion 54 which is slidably guided by a bushing 55 in the fixed lower plate 48 of the main frame 15. The lower carrier 19 is secured rigidly to the rod 50 by three set screws 56.

With the foregoing arrangement, the guide rod 50 moves upwardly with the lower carrier 19 and slides upwardly in the bushings 52 and 55 when the rods 46 of the actuators 45 are advanced to cause the feed rolls 22 to force the wire 11 against the feed rolls 21. The reaction force resulting from the rollers 22 pressing the rollers 21 against the wire is resisted by the bushings 52 and 55 acting against the upper and lower portions 51 and 54, respectively, of the rod 50. The spacing between the bushings 52 and 55 is relatively large and thus the reaction force is spread over a relatively long distance so as to reduce cocking of the lower carrier 19 and the lower feed rolls 22.

Because the rod 50 moves with the lower carrier 19 and relative to the lower frame plate 48, a coil spring 60 (FIGS. 2 and 5) may be telescoped over the lower end portion 54 of the rod and used to shift the lower carrier downwardly when the lower ends of the cylinders 47 are de-pressurized. The spring is compressed between the lower side of the lower plate 48 and a flange 61 on the lower end of the rod 50 and enables the use of single-acting actuators 45 for raising and lowering the carrier 19.

It will be appreciated that the principles of the invention are applicable to apparatus in which a guide rod is fixedly supported at its ends by the upper carrier 18 and the lower frame plate 48 and slidably supports the lower carrier 19. In such a case, a coil spring may be telescoped over the rod and sandwiched between the carriers in order to return the lower carrier downwardly upon de-pressurization of the lower ends of the cylinders 46.

We claim:

1. Apparatus for feeding wire along a predetermined path, said apparatus comprising a main support, first and second opposed feed roll pairs located on opposite sides of said wire, first and second subsupports for said first and second feed roll pairs, first and second shaft pairs journaled by said first and second subsupports, respectively, and having free end portions fixed to said first and second feed roll pairs, respectively, means for driving said shafts to cause the feed rolls of said first and second feed roll pairs to rotate in opposite directions whereby wire is advanced along said path when the wire is pinched between said first and second feed roll pairs, said first subsupport being rigidly fixed to said main support whereby said first feed roll pair is prevented from moving bodily toward or away from said second feed roll pair, guiding means supporting said second subsupport for movement substantially perpendicular to said path to enable said second feed roll pair to move bodily toward and away from said first feed roll pair, means offset laterally from said path and operative at spaced locations on said second subsupport for urging said second subsupport toward said path to cause said second feed roll pair to force said wire against said first feed roll pair, said guiding means including a single elongated rod extending substantially perpendicular to said path, said rod being located between the rolls of the roll pairs and offset laterally from said path, said rod having a first end portion supported by said first subsupport, having an intermediate portion supporting said second subsupport and having a second end portion supported by said main support whereby said first and second end portions of said rod react against said first subsupport and said main support, respectively, when said second feed roll pair forces said wire against said first feed roll pair.

2. Apparatus as defined in claim 1 in which said first and second end portions of said rod are slidably supported and guided by said first subsupport and said main support, respectively, said intermediate portion of said rod being fixed to and supporting said second subsupport against movement relative to said rod.

3. Apparatus as defined in claim 1 wherein the means for urging comprises first and second actuators connected to the second subsupport at positions near the shafts of the respective shaft pair in the second subsupport and offset laterally from said path.

4. Apparatus for feeding wire along a predetermined path, said apparatus comprising a main support, a pair of first feed rolls spaced along said path and located on one side of said wire, a pair of second feed rolls spaced along said path and located on the opposite side of said wire in opposing relation with said first feed rolls, first and second subsupports rotatably journaling said first and second feed rolls, respectively, means for rotating said first feed rolls in one direction and said second feed rolls in the opposite direction whereby wire is advanced along said path when the wire is pinched between said first and second feed rolls, said first subsupport being rigidly fixed to said main support whereby said first feed rolls are prevented from moving bodily toward and away from said second feed rolls, guiding means supporting said second subsupport for movement substantially perpendicular to said path to enable said second feed rolls to move bodily toward and away from said first feed rolls, means for urging said second subsupport toward said path to cause said second feed rolls to force said wire against said first feed rolls, said guiding means comprising an elongated rod offset laterally from and extending substantially perpendicular to said path, said rod having a first end portion slidably guided by said first subsupport, having an intermediate portion fixed rigidly to said second subsupport and having a second end portion slidably guided by said main support whereby said first and second end portions of said rod react against said first subsupport and said main support, respectively, when said second feed rolls force said wire against said first feed rolls.

5. Apparatus as defined in claim 4 in which said rod and said urging means are disposed in a common plane extending perpendicular to said path.

6. Apparatus as defined in claim 4 in which said rotating means comprise a power-driven unit with a rotary output shaft, a drive pulley rotatable by said output shaft, driven pulleys rotatable with said first and second rolls, and a drive belt with oppositely facing driving sides, said belt being trained around said pulleys with one side of said belt in driving engagement with the pulleys of said first rolls and with the other side of said belt in driving engagement with the pulleys of said second rolls so as to cause said first rolls to be driven in said one direction and to cause said second rolls to be driven in said opposite direction.

7. Apparatus as defined in claim 4 in which the means for urging comprises first and second actuators connected to the second subsupport at spaced locations corresponding generally to the positions of the feed rolls, and bracketing the position of said rod.

8. Apparatus as defined in claim 4 in which said rolls include shafts which project from said subsupports, said rod being substantially centered between the rolls of each pair.

9. Apparatus for feeding wire along a predetermined path comprising:

a main support;

a first subsupport rigidly fixed to the main support, the first subsupport supporting two laterally spaced apart feed rolls journaled for rotation on the first subsupport;

a second subsupport supporting two laterally spaced apart feed rolls journaled for rotation on the second subsupport;

guiding means supporting said second subsupport and for moving said second subsupport substantially perpendicular to the path of the wire toward and away from the first subsupport to cause the feed rolls of the second subsupport to engage and disengage the feed rolls of the first subsupport, the guiding means including a single elongated rod offset laterally and extending substantially perpendicular to the path; and means for urging the second subsupport toward said first subsupport, the urging means including a pair of actuators extending perpendicular to the path and disposed in a common plane with the elongated rod, the actuators being spaced apart on either side of the elongated rod, with the rod being substantially centered therebetween.

* * * * *